US012742248B2

(12) United States Patent
Magori et al.

(10) Patent No.: US 12,742,248 B2
(45) Date of Patent: Sep. 22, 2026

(54) DEVICE AND METHOD FOR CARBON DIOXIDE ELECTROLYSIS OR CARBON MONOXIDE ELECTROLYSIS

(71) Applicant: Siemens Energy Global GmbH & Co. KG, Munich (DE)

(72) Inventors: Erhard Magori, Feldkirchen (DE); Remigiusz Pastusiak, Munich (DE); Angelika Tawil, Munich (DE); Kerstin Wiesner-Fleischer, Höhenkirchen-Siegertsbrunn (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 968 days.

(21) Appl. No.: 17/912,511

(22) PCT Filed: Mar. 11, 2021

(86) PCT No.: PCT/EP2021/056136
§ 371 (c)(1),
(2) Date: Sep. 18, 2022

(87) PCT Pub. No.: WO2021/197787
PCT Pub. Date: Oct. 7, 2021

(65) Prior Publication Data

US 2023/0145019 A1 May 11, 2023

(30) Foreign Application Priority Data

Apr. 1, 2020 (DE) ..... 10 2020 204 224.1

(51) Int. Cl.
*C25B 11/031* (2021.01)
*C25B 1/23* (2021.01)
(Continued)

(52) U.S. Cl.
CPC ..... *C25B 11/031* (2021.01); *C25B 1/23* (2021.01); *C25B 3/25* (2021.01); *C25B 3/26* (2021.01);
(Continued)

(58) Field of Classification Search
CPC .... C25B 1/23; C25B 3/00; C25B 3/25; C25B 3/26; C25B 9/23; C25B 11/031;
(Continued)

(56) References Cited

U.S. PATENT DOCUMENTS 4,263,112 A * 4/1981 Frosch ..... C25B 1/04 204/266
4,425,217 A 1/1984 Beer
(Continued)

FOREIGN PATENT DOCUMENTS

CN 103160851 A 6/2013
CN 104701549 A 6/2015
(Continued)

OTHER PUBLICATIONS

Jang et al. "Iridium oxide fabrication and application: A review" Journal of Energy Chemistry 46 (2020) 152-172 (Year: 2020).*
(Continued)

*Primary Examiner* — Luan V Van
*Assistant Examiner* — Alexander R. Parent
(74) *Attorney, Agent, or Firm* — Wolter Van Dyke Davis, PLLC

(57) ABSTRACT

An anode-side half cell for an electrochemical cell of an electrolytic apparatus for carbon dioxide electrolysis and/or carbon monoxide electrolysis, having a separator in the form of a diaphragm, which has an anode-side separator surface and a cathode-side separator surface opposite the anode-side separator surface; a catalyst layer, which has a first catalyst surface and a second catalyst surface opposite the first
(Continued)

catalyst surface, the first catalyst surface facing the anode-side separator surface; and a fluid-permeable anode plate, which has a first anode surface, the first anode surface facing the second catalyst surface.

14 Claims, 6 Drawing Sheets

(51) Int. Cl.

| | |
|---|---|
| ***C25B 3/25*** | (2021.01) |
| ***C25B 3/26*** | (2021.01) |
| ***C25B 9/23*** | (2021.01) |
| ***C25B 9/65*** | (2021.01) |
| ***C25B 9/77*** | (2021.01) |
| ***C25B 11/032*** | (2021.01) |
| ***C25B 11/052*** | (2021.01) |
| ***C25B 11/063*** | (2021.01) |

(52) U.S. Cl.
CPC ..... *C25B 9/23* (2021.01); *C25B 9/65* (2021.01); *C25B 9/77* (2021.01); *C25B 11/032* (2021.01); *C25B 11/052* (2021.01); *C25B 11/063* (2021.01)

(58) Field of Classification Search
CPC ... C25B 11/032; C25B 11/052; C25B 11/053; H01M 4/86; H01M 4/88; H01M 4/8803; H01M 4/8807; H01M 8/0202; H01M 8/0247; H01M 8/0254; H01M 8/0271; H01M 8/0273; H01M 8/0276
See application file for complete search history.

(56) References Cited

U.S. PATENT DOCUMENTS

| | | | | |
|---|---|---|---|---|
| 4,602,984 | A | 7/1986 | Beaver | |
| 4,855,032 | A * | 8/1989 | Fabian | C25B 9/65 204/288.3 |
| 4,923,583 | A | 5/1990 | Woodard | |
| 2003/0162081 | A1 * | 8/2003 | Gestermann | H01M 4/8828 429/510 |
| 2009/0029039 | A1 * | 1/2009 | Okumura | H01M 4/886 427/115 |
| 2013/0146448 | A1 | 6/2013 | Wang | |
| 2015/0152564 | A1 * | 6/2015 | Sekimoto | C25B 11/077 204/252 |
| 2015/0303487 | A1 | 10/2015 | kamai | |
| 2017/0321333 | A1 | 11/2017 | Kuhl | |
| 2018/0006315 | A1 | 1/2018 | Pierpont | |
| 2018/0241095 | A1 | 8/2018 | Nozaki | |
| 2018/0258542 | A1 | 9/2018 | Yoshida | |
| 2019/0085473 | A1 | 3/2019 | Sugano | |
| 2020/0080211 | A1 | 3/2020 | Schmid | |
| 2020/0291537 | A1 | 9/2020 | Jeanty | |
| 2020/0385877 | A1 | 12/2020 | Martic | |
| 2021/0079538 | A1 * | 3/2021 | Schmid | C25B 9/19 |
| 2022/0025530 | A1 * | 1/2022 | Funakawa | C25B 1/46 |

FOREIGN PATENT DOCUMENTS

| | | | | |
|---|---|---|---|---|
| CN | 109643813 | A | 4/2019 | |
| DE | 102018100722 | A1 | 8/2018 | |
| DE | 102017208610 | A1 | 11/2018 | |
| DE | 102017219766 | A1 | 5/2019 | |
| EP | 0082643 | A2 | 6/1983 | |
| EP | 2709959 | A1 | 3/2014 | |
| GB | 1257934 | A | 12/1971 | |
| GB | 2323700 | A | 9/1998 | |
| GB | 2348047 | A | 9/2000 | |
| JP | H07220727 | A | 8/1995 | |
| JP | 2003308848 | A | 10/2003 | |
| JP | 2006286476 | A | 10/2006 | |
| KR | 20160074241 | A * | 6/2016 | C25B 13/02 |
| WO | 2017192787 | A1 | 11/2017 | |
| WO | 2019011577 | A1 | 1/2019 | |
| WO | 2019096540 | A1 | 5/2019 | |
| WO | WO-2020059888 | A1 * | 3/2020 | C25B 11/093 |
| WO | 2020259888 | A1 | 12/2020 | |

OTHER PUBLICATIONS

PCT International Search Report and Written Opinion of International Searching Authority mailed Jul. 16, 2021 corresponding to PCT International Application No. PCT/EP2020/056042 filed Mar. 11, 2021.

Ahmed, Jahangeer et al:; "Ultrafine Iridium Oxide Nanorods Synthesized by Molten Salt Method toward Electrocatalytic Oxygen and Hydrogen Evolution Reactions"; Electrochimica Acta; vol. 212; pp. 686-693; ISSN: 0013-4686; https://doi.org/10.1016/j.electacta.2016.06.122; 2016.

* cited by examiner

DEVICE AND METHOD FOR CARBON DIOXIDE ELECTROLYSIS OR CARBON MONOXIDE ELECTROLYSIS

CROSS REFERENCE TO RELATED APPLICATIONS

This application is the US National Stage of International Application No. PCT/EP2021/056136 filed 11 Mar. 2021, and claims the benefit thereof. The International Application claims the benefit of German Application No. DE 10 2020 204 224.1 filed 1 Apr. 2020. All of the applications are incorporated by reference herein in their entirety.

FIELD OF INVENTION

The invention relates to an anode-side half-cell for an electrochemical cell of an electrolysis device for carbon dioxide electrolysis and/or for carbon monoxide electrolysis. The invention further relates to an electrochemical cell of an electrolysis device for carbon dioxide electrolysis and/or for carbon monoxide electrolysis, having a cathode region that has an electrical cathode connection, a gas diffusion electrode, a first feed connection for supply of carbon dioxide, and a first drain connection for draining of electrolysis substances at least partly formed in the intended operation of the electrochemical cell, an anode region which is formed separately from the cathode region by means of a separator and has an electrical anode connection, an anode plate, a second feed connection for supply of a proton-releasing substance and a second drain connection for draining of electrolysis residues at least partly formed in the intended operation of the electrochemical cell, wherein the cathode connection and the anode connection are designed to be electrically coupled to corresponding electrical connections of an energy source that provides an electrical electrolysis voltage. The invention further relates to an electrolysis device for carbon dioxide electrolysis and/or for carbon monoxide electrolysis. Finally, the invention also relates to a method of producing an anode-side half-cell for an electrochemical cell of an electrolysis device for carbon dioxide electrolysis and/or for carbon monoxide electrolysis.

BACKGROUND OF INVENTION

Anode-side cells, electrochemical cells, electrolysis devices for carbon dioxide electrolysis and/or for carbon monoxide electrolysis and methods of producing anode-side cells are basically known in the prior art, and so there is no need for any separate published evidence thereof. Electrochemical cells and electrolysis devices formed therefrom serve for at least partial conversion of carbon dioxide to carbon monoxide and/or to other hydrocarbons. As well as carbon dioxide, it is alternatively or additionally also possible to utilize carbon monoxide in order to at least partly generate the other hydrocarbons.

Carbon dioxide is a substance which is formed in the utilization of fossil fuels in particular and is released into the atmosphere in large volumes. Carbon dioxide is a greenhouse gas and is therefore an unwanted substance in the atmosphere. The invention addresses the question of making carbon dioxide utilizable for a broad range of the chemical industry. Carbon monoxide, by contrast, is a starting material for the chemical industry and can be utilized for the production of a multitude of chemical products. The generation of carbon monoxide from carbon dioxide can achieve this aim in an improved manner, if not actually for the first time. Furthermore, in the context of carbon dioxide electrolysis, it is also possible to produce other hydrocarbons, for example methane, alcohols and/or the like. These other substances may also be obtained by an electrolysis of carbon monoxide.

In practice, it has been found that the production of carbon monoxide or of the other hydrocarbons from carbon dioxide or carbon monoxide not only entails a high level of complexity but is additionally also associated with problems. For example in relation to carbon dioxide electrolysis, it is necessary for the carbon dioxide to be at least partly converted to carbon monoxide by reduction. For this purpose, it is necessary to provide an environment suitable for the reduction and a substance that permits the reduction of the carbon dioxide via oxidation thereof. In many applications, it is therefore customary to use an ion-conducting solution or a water-based electrolyte within the electrochemical cell. In an anode-side region of the electrochemical cell, the ion-conducting solution or the water-based electrolyte is split, such that protons can be provided and oxygen is released. The water from the ion-conducting solution or the water-based electrolyte here is thus a proton-releasing substance. This part of the reaction generally takes place in the region of the anode or anode region.

After passing through a suitable separator which is preferably permeable exclusively to protons, the protons can then be provided in a cathode region of the electrochemical cell for the reduction of the carbon dioxide. A reaction in the cathode region then at least partly splits the carbon dioxide, which produces carbon monoxide. In addition, the oxygen released can then, for example, form water together with the protons.

The electrochemical cell generally has at least a cathode region, and an anode region formed separately from the cathode region by means of the separator. For performance of the electrochemical reaction in the electrochemical cell, an anode is disposed in the anode region and a cathode in the cathode region, which are subjected to a suitable electrical potential. Additionally disposed at least in the anode region is a catalyst that assists or enables the desired reaction in the anode region.

For the performance of the desired chemical reaction in the electrochemical cell, the desired substances may either be at least partly in liquid form or at least partly in gaseous form. If at least the carbon dioxide is supplied in gaseous form, the cathode may have a gas diffusion electrode, for example. The gas diffusion electrode permits reacting of a solid substance, a liquid substance and a gaseous substance with one another, such that the desired electrochemical reaction can be achieved. A gas diffusion electrode is known, for example, from European patent application 19 182 017.4.

The reaction in the electrochemical cell preferably uses an electrolyte. The electrolyte may be formed, for example, by a preferably aqueous salt solution. If the salt solution is used as electrolyte, the electrolyte on the anode side and cathode side may be the same. The electrolyte may therefore be provided from a single reservoir. Such an electrolyte is occasionally also called monolyte. In addition, it is of course also possible to utilize different electrolytes in the anode region and in the cathode region, in which case the cathode region has a catholyte and the anode region an anolyte. In the anode region, the anolyte may be formed by water, whereas the catholyte in the cathode region may be formed by a catholyte in the form of a salt solution. Furthermore, further electrolyte arrangements are conceivable.

In electrolysis devices of the generic type, it is found to be problematic, especially in relation to the anode, to achieve a uniform current density distributed over the reaction area envisaged in order that a good action of the electrochemical cell can be achieved. Problematic substances are especially found to be substances that are simultaneously also to serve as catalyst and provide electrical conductivity. Furthermore, it has been found to be problematic, especially on the anode side, to arrange the different components in a defined position and to connect them to one another in a defined manner. This results in complex assembly and construction. Reliability may be impaired both in the production of the electrochemical cell and in operation as intended.

Similar problems can arise in the electrolysis of carbon monoxide.

SUMMARY OF INVENTION

It is an object of the invention to improve an anode-side half-cell of generic type, an electrochemical cell, an electrolysis device of generic type, and also a process for production thereof, such that the homogeneity of current density in the region of the anode is improved and the production or construction of the electrochemical cell, especially of the anode-side half-cell, can be improved.

The solution proposed by the invention is an anode-side half-cell, an electrochemical cell, an electrolysis device and a process for production thereof according to the independent claims.

Advantageous developments will be apparent from features of the dependent claims.

In relation to an anode-side half-cell of the generic type, what is proposed is more particularly that the anode-side half-cell has a separator which is in the form of a membrane and has an anode-side separator surface and a cathode-side separator surface on the opposite side from the anode-side separator surface, a catalyst layer having a first catalyst surface and a second catalyst surface on the opposite side from the first catalyst surface, wherein the first catalyst surface faces the anode-side separator surface, and a fluid-permeable anode plate having a first anode surface, wherein the first anode surface faces the second catalyst surface.

In addition, in relation to an electrochemical cell of the generic type, what is proposed is more particularly that the anode region and the separator take the form of the anode-side half-cell according to the invention.

In relation to an electrolysis device of the generic type, what is proposed is more particularly that the electrochemical cells are designed according to the invention, wherein the electrochemical cells are in a spatially directly adjoining arrangement.

In relation to a method of the generic type, what is proposed more particularly by the invention is that it has the following steps:

- arranging an anode-side separator surface of a separator which is in the form of a membrane and has a cathode-side separator surface on the opposite side from the anode-side separator surface at a first catalyst surface of a catalyst layer, which catalyst layer has a second catalyst surface on the opposite side from the first catalyst surface, and
- arranging a first anode surface of a fluid-permeable anode plate at the second catalyst surface.

One concept of the invention is to construct the electrochemical cell in a modular manner, such that not just efficacy but also reliability and manufacturing technology can be improved. Furthermore, it is possible to achieve a modular construction that permits improvement of the electrical coupling in relation to the electrical anode connection on the anode side, such that an improvement in homogeneity can be achieved overall in relation to the electrical current density of the anode. Overall, the invention permits firstly simplification of assembly and simultaneously also an increase in reliability in assembly, and secondly an improvement in efficiency, especially Faraday efficiency, and also in reliability in operation as intended. As a result, it is also possible to improve efficiency overall in relation to the carbon dioxide electrolysis.

The anode-side half-cell is preferably a construction unit which is part of a construction, especially a modular construction, of the electrochemical cell. The anode-side half-cell is preferably an assembly that can be handled separately. The anode-side half-cell provides the anode space and the separator, and can thus be connected in a simple manner to the further components or construction elements of the electrochemical cell. It is the construction of the anode-side half-cell here that permits provision of a ready-tested construction unit for the completion of the electrochemical cell, such that the assembly can be simplified overall. Furthermore, it is possible to increase reliability in the region of the assembly. At least the anode-side half-cell preferably has a stacked construction. In particular, the elements thereof are arranged in direct succession. The stacked construction may be at least partly fixed by means of mechanical connecting elements. The connection may be designed so as to be partable or else unpartable. In addition, the anode-side half-cell may have a dedicated housing or partial housing. The housing or partial housing may at least partly serve as connecting element. In addition, it is possible to provide clamps, clips, screws, rivets and/or the like as connecting elements. It is also possible to provide an adhesive, a solder and/or the like as connecting elements. These construction features may of course equally also be provided for the cathode-side half-cell or else for the electrochemical cell that has the anode-side half-cell and the cathode-side half-cell.

It is preferably also possible to provide a cathode-side half-cell comprising the corresponding elements of the cathode space. For completion of the electrochemical cell, all that is then needed is arrangement of at least these two elements, namely the anode-side half-cell and the cathode-side half-cell, in combination with one another, in order to form the electrochemical cell. According to the construction and requirements, however, additional elements may also be provided.

In particular, it may of course be the case that the electrochemical cell has a housing in which at least the anode-side half-cell is disposed. This may also be the case for the cathode-side half-cell. At least on the cathode side, however, it may also be the case that some of the elements or components of the anode-side half-cell are disposed in a defined manner as elements that can be handled individually. They may then be bonded to one another with mechanical connecting elements in order to obtain or to fix the desired arrangement. The connecting elements may, for example, be clamp rings, screw connections, clip connections and/or the like.

The electrochemical cell provides a reaction region that permits at least partial conversion of the carbon dioxide which is preferably supplied in gaseous form to carbon monoxide. However, the carbon dioxide may also be supplied in liquid form by means of a solvent. The solvent may simultaneously form an electrolyte in the electrochemical cell, but at least a catholyte.

The electrochemical cell may, for example, have an electrical cathode connection in the cathode region that permits the establishment of an electrical connection to the electrical energy source that can subject the cathode connection to an electrical cathode potential. The electrical cathode potential is different than the electrical anode potential and is preferably chosen such that the desired electrochemical reaction can be achieved. The electrical potential difference between the electrical anode potential and the electrical cathode potential is, for example, about 7 V, preferably less than about 7 V, more preferably 5 V or less, especially about 3.8 V.

The cathode region further comprises a gas diffusion electrode and a first feed connection for supply of carbon dioxide, especially in the form of a gas, and a first drain connection for draining of electrolysis substances at least partly formed in the intended operation of the electrochemical cell. The electrolysis substances especially include the carbon monoxide generated by the intended electrolysis, which is preferably likewise in the form of a gas. In addition, the electrolysis substances may also include residues of carbon dioxide that has not been converted in the intended operation of the electrochemical cells. Finally, further substances may be present as electrolysis substances, for example water, especially in the form of water vapor, hydrogen and/or the like. As required, the electrolysis substances may be separated from one another by separating methods, such that, in particular, the carbon monoxide generated by the intended operation of the electrochemical cell can be separated from the further substances.

The separator is preferably a separator which is permeable to protons. The separator is preferably permeable exclusively to protons, being formed, for example, from a substance such as Nafion or the like. The separator may, for example, also have an ion-conducting membrane, a porous material that allows liquids through, for example a frit or porous material on a support grid, polymer-bound porous material and/or the like, where the aforementioned materials may, for example, also serve as carrier. The separator may take the form of a thin film or layer, especially of the membrane type. Furthermore, the separator may also be formed in one piece together with at least one of the adjacent elements of the electrochemical cell, especially together with the catalyst layer.

The catalyst layer is a layer that extends at least partly parallel to the separator. The catalyst layer and an anode-side separator surface are preferably connected to one another and form a one-piece unit. The catalyst layer comprises a suitable substance that permits release of protons from a proton-releasing substance supplied to the anode region via a second feed connection, and supply thereof to the cathode region via the separator. The proton-releasing substance may, for example, be water, a salt solution and/or the like. The anode region may additionally have a second drain connection for draining of electrolysis residues at least partly formed in the intended operation of the electrochemical cell. If the electrolyte or anolyte is formed by water, the residue may comprise, for example, oxygen, especially in gas form.

In addition, the anode region may have an electrical anode connection that can be electrically coupled to the electrical energy source in a corresponding manner to the cathode connection in the cathode region, such that the anode of the anode region can be subjected to the electrical anode potential.

The separator has an anode-side separator surface and a cathode-side separator surface on the opposite side from the anode-side separator surface. The catalyst layer likewise has a first catalyst surface and a second catalyst surface on the opposite side from the first catalyst surface. The first catalyst surface faces the anode-side separator surface. One possible meaning of "facing" is that the first catalyst surface and the anode-side separator surface are arranged opposite one another. These surfaces may preferably be in contact with one another. More preferably, these two surfaces are bonded to one another, especially bonded to one another in a fixed manner, such that they can form, for example, an integral construction unit. In particular, the catalyst layer may be arranged in the manner of a coating on the anode-side separator surface. This can improve the production of the electrochemical cell and also of the anode-side half-cell, and can also increase reliability in operation as intended.

The anode-side half-cell further comprises the fluid-permeable anode plate having a first anode surface and a second anode surface on the opposite side from the first anode surface. The first anode surface faces the second catalyst surface. Here too, it is possible for the two surfaces to be arranged opposite one another. These two surfaces are preferably bonded to one another, for example bonded to one another in a fixed manner. The anode plate is preferably composed of a material of good electrical conductivity, for example titanium or a titanium alloy or the like. The anode plate is additionally preferably formed in such a way that it permits the supply of the electrolyte, especially of the anolyte, to the catalyst surface, specifically to the second catalyst surface. The anolyte—like the catholyte too—may be liquid and/or gaseous. In addition, the construction of the anode plate can also achieve the effect that the electrolysis residues can be removed from the region of the second catalyst surface. This can enable sustained intended operation of the electrochemical cell.

The anode plate preferably comprises a second anode surface on the opposite side from the first anode surface and a contact plate disposed on the second anode surface, wherein at least the anode plate or the contact plate serves for electrical connection to an electrical energy source that provides an electrical anode potential. The contact plate can reduce, if not entirely avoid, electrical stress gradients in the intended operation of the electrochemical cell.

The contact plate is disposed on the second anode surface, and preferably makes not just mechanical but also electrical contact therewith. At least the anode plate or the contact plate serve for electrical connection to the electrical energy source. The contact plate is preferably likewise formed from a material of good electrical conductivity. The contact plate is preferably formed from titanium or a titanium alloy. In addition, the contact plate, however, may also have additional structures of good electrical conductivity, for example made of a different material having good electrical conductivity, such as silver, silver alloys, copper, copper alloys and/or the like. This construction can improve a homogeneous distribution of the anode potential over the second anode surface and hence also over the first anode surface, it being possible to reduce effects owing to different current density over the anode surface. This permits better homogenization of the functionality of the electrochemical cell over the available surface area, such that efficiency can be improved overall.

The contact plate may take the form of a rigid plate and preferably has dimensions like the anode plate. At least with regard to the first and second anode surfaces, the anode plate has dimensions that are preferably matched to the second catalyst surface in order to be able to achieve high functionality.

The cathode connection and the anode connection of the electrochemical cell are preferably designed to be electrically coupled to corresponding electrical connections of the energy source that provides the electrical electrolysis voltage. For this purpose, corresponding electrical connections may be provided, which in the usual manner permit electrical contact connection, for example plug connections, screw connections, weld connections and/or the like.

With regard to the electrolysis device, it is further proposed that the electrochemical cells are in a spatially directly adjoining arrangement. This can achieve a compact construction of the electrolysis device overall, and it is simultaneously also possible to achieve simple connection of the electrochemical cells. In particular, the first and second feed connections and the first and second drain connections may be connected in parallel for flow purposes, such that the electrochemical cells can be supplied essentially uniformly with the required substances, and the corresponding products can simultaneously be drained off by the intended operation of the electrochemical cell. In addition, it is possible in a simple manner to achieve electrical interconnection of the electrochemical cells for the operation as intended. The electrochemical cells may at least partly be connected in series and/or in parallel.

In terms of process technology, it may be the case that the anode-side separator surface is disposed on the first catalyst surface. This can be achieved, for example, in that the anode-side separator surface is coated with the catalyst. This can achieve a reliable fixed bond between the separator and the catalyst. The second catalyst surface may then be bonded to first anode surfaces, for example by means of an electrically conductive adhesive or the like. However, it may in principle also be the case that the first anode surface is prestressed by means of a force with respect to the second catalyst surface, in order to be able to achieve corresponding contact connection. In addition, it may be the case that a first layer of catalyst material is applied to the first anode surface of the anode plate. The first layer of catalyst material formed thereby may be bonded in the manner of a coating to the first anode surface. A second layer of separator material may be applied to this layer of catalyst material. The second layer of separator material is preferably also bonded in the manner of a coating to the first layer of catalyst material. It is thus possible in a simple manner to create a one-piece construction unit. It is of course also possible to provide combinations of the aforementioned executions.

In addition, the contact plate may be disposed on the second anode surface, such that a good electrical contact connection between the anode plate and the contact plate can be achieved. This means that the anode potential may be essentially homogeneous, preferably uniform, over the anode plate, such that the anode potential in the second catalyst surface too is available in a very substantially homogeneous manner. At least the anode plate or the contact plate serves for electrical connection to the electrical energy source, for which purpose corresponding connection means may be provided, which permit establishment of a reliable electrically conductive connection to the electrical energy source. For this purpose, separate connection means may be provided, which make contact with the anode plate and/or the contact plate. In this way, it is possible to achieve a simple production method which is at the same time also of good suitability for mass production, especially automated mass production. In this way, it is possible to achieve not just reliability in the production of the electrochemical cells, especially of the anode-side half-cell, but also in intended operation since this production process permits assurance of uniform production conditions with maximum homogeneity.

It is additionally proposed that the catalyst layer at least partly includes iridium(IV) oxide. This material is particularly suitable for utilization as catalyst for performance of the carbon dioxide electrolysis. Of course, the iridium(IV) oxide may also be mixed with further substances that further improve its function as catalyst, or at least improve the mechanical properties of the catalyst layer. In addition, it is also possible to provide a different metal oxide. It is also possible to provide combinations thereof.

In one development, it is proposed that at least the anode plate or the contact plate includes titanium and/or a titanium alloy. It has been found that titanium in the region of the anode is particularly favorable for carbon dioxide electrolysis. At the same time, titanium enables provision of good electrical conductivity, such that anode potential may have maximum uniformity over the surfaces of the anode plate.

In a further advantageous configuration, it is proposed that the anode plate is at least partly porous. The porosity of the anode plate enables, in a simple manner, supply of the fluid anolyte or of the proton-releasing substance into the region of the catalyst or of the catalyst layer. The porosity can be established using known methods. In addition, it may of course be the case that the anode plate provides supplementary passage openings that open out in the respective opposite anode surfaces. According to the construction, these passage openings may be uniformly or else unsymmetrically distributed over the extent of the anode surfaces. The porosity may be chosen in a suitable manner depending on a viscosity and/or further physical properties, for example the temperature or the like, of the anolyte and/or of the proton-releasing substance.

It is further proposed that the first anode surface is bonded to the second catalyst surface by means of an electrically conductive bonding technique. The electrically conductive bonding technique enables fixed bonding of the first anode surface to the second catalyst surface, such that a construction unit, especially a one-piece construction unit, can be formed. At the same time, it is possible to achieve a connection of good electrical conductivity, preferably over a contacting area of maximum size, between the first anode surface and the second catalyst surface. This permits any potential gradient in relation to the electrical anode potential in the intended operation of the electrochemical cell to be largely reduced, if not essentially completely suppressed. The electrically conductive bonding technique may be implemented, for example, by means of welding, adhesive bonding, soldering, combinations thereof and/or the like. By means of the electrically conductive bonding technique, it is possible to achieve an electrically conductive connection at multiple points and/or over an area, for example over the entire contact area or a definable subregion of the contact area.

The bonding technique preferably utilizes an electrically conductive adhesive. In this way, the first anode surface may be bonded to the second catalyst surface by means of the electrically conductive adhesive. In this way, the fixed bond between the first anode surface and the second catalyst surface can be achieved in a simple and reliable manner, such that a fixed bond can be achieved, which can be handled separately. Furthermore, this bond may be tested separately with regard to its functionality. This enables an improvement in reliability. The adhesive utilized may, for example, be an electrically conductive adhesive based, for example, on 1-20 wt % PTFE, 1-20 wt % PVDF or the like. In addition, it is also possible to use epoxy resin- or cyanoacrylate-based adhesion adhesives.

The adhesive preferably includes particles of iridium(IV) oxide. This can achieve a particularly favorable transition between the adhesive and the catalyst. The adhesive therefore need not have an unfavorable effect on the action of the catalyst. Instead, it may further assist the action of the catalyst.

The adhesive may be disposed over an area between the first anode surface and the second catalyst surface. It may alternatively be the case that the adhesive is disposed merely partially between the two aforementioned surfaces, for example to form a definable pattern or the like. This can firstly minimize the demand for adhesive and secondly achieve a reliable good bond of the respective surfaces to one another.

It is further proposed that the second catalyst surface has projections that protrude from this surface and project into the anode plate through the first anode surface for bonding to the anode plate. This permits further improvement of the connection of the second catalyst surface to the first anode surface. In particular, in the region of the first anode surface, it is possible to achieve a transition region on the anode plate side in that catalyst material is already present, such that the catalytic function can be improved further. Overall, it is thus also possible to improve the efficiency of the anode-side half-cell, and hence of the electrochemical cell as well.

In addition, it is proposed that the projections are formed from the same material as the catalyst layer. In this way, it is possible not just to achieve a good bond, but also to improve the function of the catalyst.

The projections may be designed to be pressed into the anode plate and in this way to improve a fixed bond between the first anode surface and the second catalyst surface. In particular, this can achieve better absorption of any shearing effect between the two surfaces.

In addition, it is proposed that the projections are formed by mutually spaced pins and the anode plate, especially the first anode surface, has receiving openings for receiving the pins. This makes it possible to at least mechanically, but preferably also electrically, couple the anode plate to the catalyst layer in the manner of a plug connection. For this purpose, the receiving openings may be adapted to mechanical dimensions of the pins, in order to enable not only mechanical bonding but also electrical connection. This can further improve the homogeneity of the electrical anode potential in the region of the catalyst layer. The plug connection may take the form of a pin-grid array (PGA) in which the contacts, here the receiving openings and the pins, are arranged in a defined pattern. Likewise possible is the arrangement of the contacts in the manner of a staggered pin-grid array (SPGA) in which the contacts are arranged offset to one another in adjacent rows. For establishment of the plug connection, the pins may be formed in relation to the receiving openings in such a way that a defined force is required to insert the plug. The connection may preferably take the form of a low-insertion-force (LIF) connection. In addition, the connection may take the form of a zero-insertion-force (ZIF) connection, in which the connection can be achieved with essentially zero force. It may be the case here that, in the inserted state, by means of a clamp device, a clamp connection is provided between the pins and the receiving openings. The clamp connection may be actuated by means of a preferably manually actuatable drive element, such that it is possible to switch between a locked state and an unlocked state. This can not only achieve a reliable connection, but it is also possible to achieve releasability of the connection.

In one development, it is proposed that the contact plate has a contact plate surface which is on the opposite side from the second anode surface and has connecting elements at least for mechanical connection of the contact plate surface to the second anode surface. In this way, it is possible to connect the contact plate to the second anode surface in a mechanically fixed manner. Furthermore, it is possible simultaneously to also establish a good electrical connection between the second anode surface and the contact plate. This connection can further improve the homogeneity of the anode potential of the anode plate. The contact plate is preferably likewise formed from a material of good electrical conductivity which can be selected in a suitable manner for the material of the anode plate. For example, the contact plate may likewise be formed from titanium or a titanium alloy. The contact plate may additionally at least partly also have connection regions that may be formed from a material of good electrical conductivity such as silver, silver alloys, copper, copper alloys and/or the like. In addition, the contact plate may also have corresponding conduction patterns over its two-dimensional extent that further improve the electrical conductivity of the contact plate overall and hence further assist the homogeneity of the anode potential.

Preferably, the connecting elements and the contact plate are electrically conductive. The connecting elements may, for example, be formed from the same material as the contact plate. The connecting elements may be formed, for example, by projections of the contact plate. The projections may be designed to be able to make mechanical and electrical contact with the second anode surface in a defined manner. In this way, it is possible in a simple manner to achieve a reliable connection between the contact plate surface and the second anode surface which can reduce, if not largely avoid, gradients in the anode potential over the two-dimensional extent of the anode plate. The connecting elements may be bonded to the second anode surface by means of a force effect. In addition, they may also be welded or soldered.

In addition, it is suggested that the connecting elements and/or the projections are formed by pins in a spaced apart arrangement. The pins may be formed in the manner of a pattern on the contact plate surface. The pins preferably have a diameter which is less than the thickness of the contact plate. The pins may have a round or else a square cross section in their longitudinal extent. The pins are preferably formed so as to be able to establish a good electrical contact on the anode side with the second anode surface and anode plate. For this purpose, axial ends may be formed with a spike or else a hemispherical shape.

In relation to the electrochemical cell, it is further proposed that the elements of the cathode region and the anode region are arranged in a stack. By alternating arrangement of the elements of the cathode region and the anode region, it is thus possible to achieve a modular layer construction which is particularly favorable with regard to production. In addition, the stack formed thereby can be mechanically stabilized in a simple manner, such that the electrochemical cell can be handled individually from assembly. In addition, the electrochemical cell may also be tested separately. This construction is particularly advantageously suitable for automated production of electrochemical cells.

The working examples elucidated hereinafter are preferred embodiments of the invention. The features and combinations of features specified above in the description and also the features and combinations of features specified in the description of working examples that follows and/or shown in the figures alone are usable not just in the combination specified in each case, but also in other combinations. The invention should thus be considered to encompass or to disclose executions that are not shown and elucidated explicitly in the figures, but are apparent and can be created from separated combinations of features from the elucidated embodiments. The features, functions and/or effects detailed in the working examples on their own may each constitute individual features, functions and/or effects of the invention that are to be considered independently, which each also independently develop the invention. Therefore, the working examples are also to encompass combinations other than those in the elucidated embodiments. Furthermore, the embodiments described may also be supplemented by further features, functions and/or effects of the invention that have already been described.

DETAILED DESCRIPTION OF INVENTION

Figure 1:
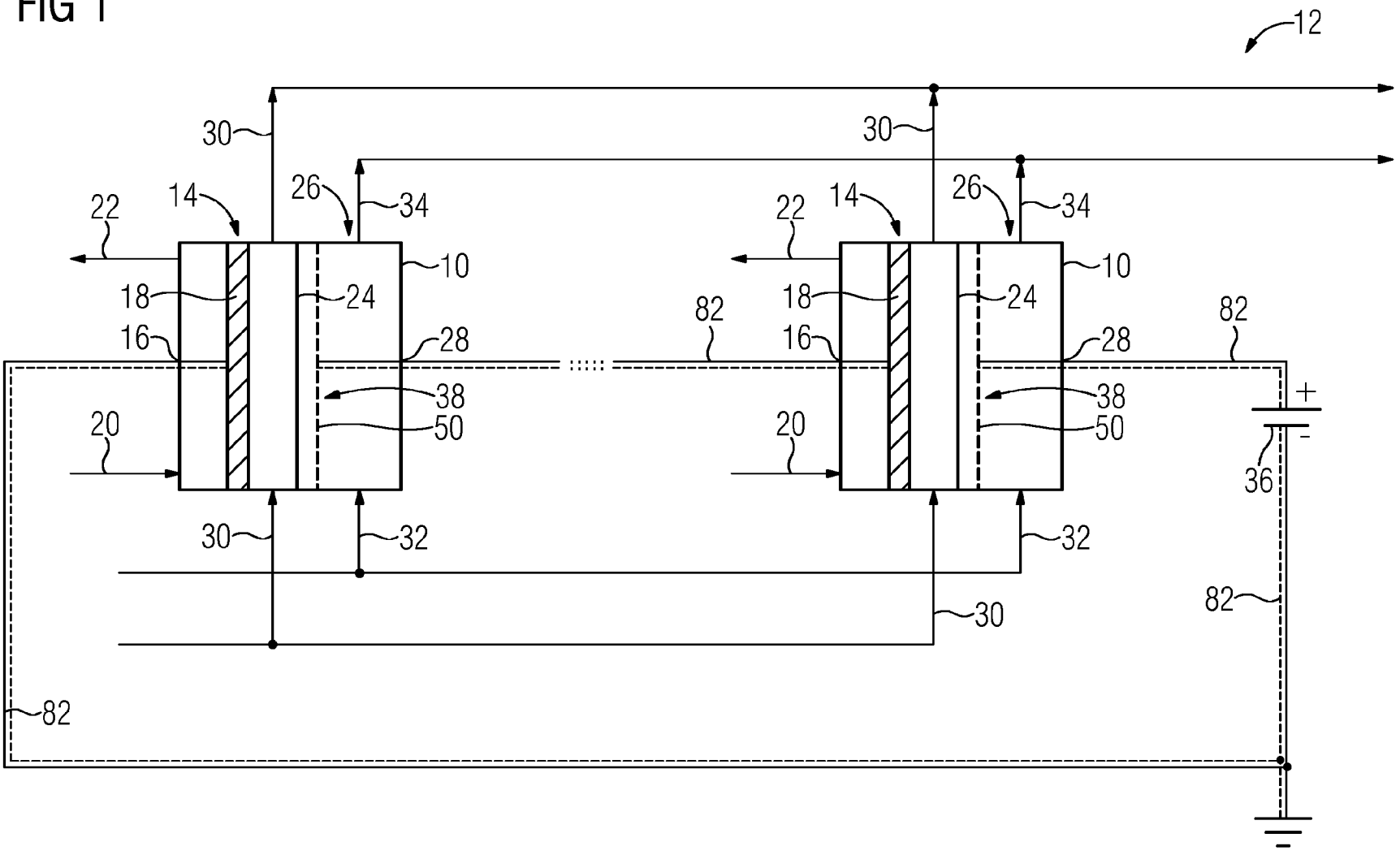
FIG. 1 shows a schematic function block view of an electrolysis device for carbon dioxide electrolysis having a multitude of electrically series-connected electrochemical cells.

FIG. 1 shows, in a schematic function block diagram, an electrolysis device 12 for carbon dioxide electrolysis, in which carbon monoxide is produced at least in part from carbon dioxide in operation as intended. The electrolysis device 12 comprises a multitude of electrochemical cells 10 in which the carbon dioxide electrolysis takes place, two of which are shown by way of example in FIG. 1. In the present configuration, the electrochemical cells 10 are electrically connected in series, with the series connection being connected to an electrical energy source 36 by means of electrical wires 82 in order to subject the electrochemical cells 10 in a corresponding manner to electrical potentials on the respective electrodes, as elucidated hereinafter.

Each of the electrochemical cells 10 has a cathode region 14 and an anode region 26 that are separated from one another by means of a separator 24. The cathode region 14 comprises an electrical cathode connection 16, a gas diffusion electrode 18 electrically coupled to the cathode connection 16, a first feed connection 20 for supply of carbon dioxide and a first drain connection 22 for draining of electrolysis substances that have formed at least in part in the intended operation of the electrochemical cell 10, which include carbon monoxide. In addition, it is of course also possible for the electrolysis substances to include a residue of carbon dioxide that has not been converted in the electrochemical cell 10. In addition, further residues are possible. Furthermore, the cathode region 14 is connected to conduits 30 for supply and draining of a catholyte, here a salt solution.

The anode region 26 comprises an electrical anode connection 28, an anode plate 50 electrically coupled to the electrical anode connection 28, a second feed connection 32 for supply of a proton-releasing substance, and a second drain connection 34 for draining of electrolysis residues at least partly formed in the intended operation of the electrochemical cell 10.

The cathode connection 16 and the anode connection 28 are designed to be electrically coupled to a suitable or appropriate electrical electrolysis voltage from the electrical energy source 36. The respective first and second feed connections 20, 32, and the respective first and second drain connections 22, 34, are each correspondingly connected in parallel for flow purposes, such that the electrochemical cells 10 can be supplied from respective sources for the appropriate substances in operation as intended.

Figure 2:
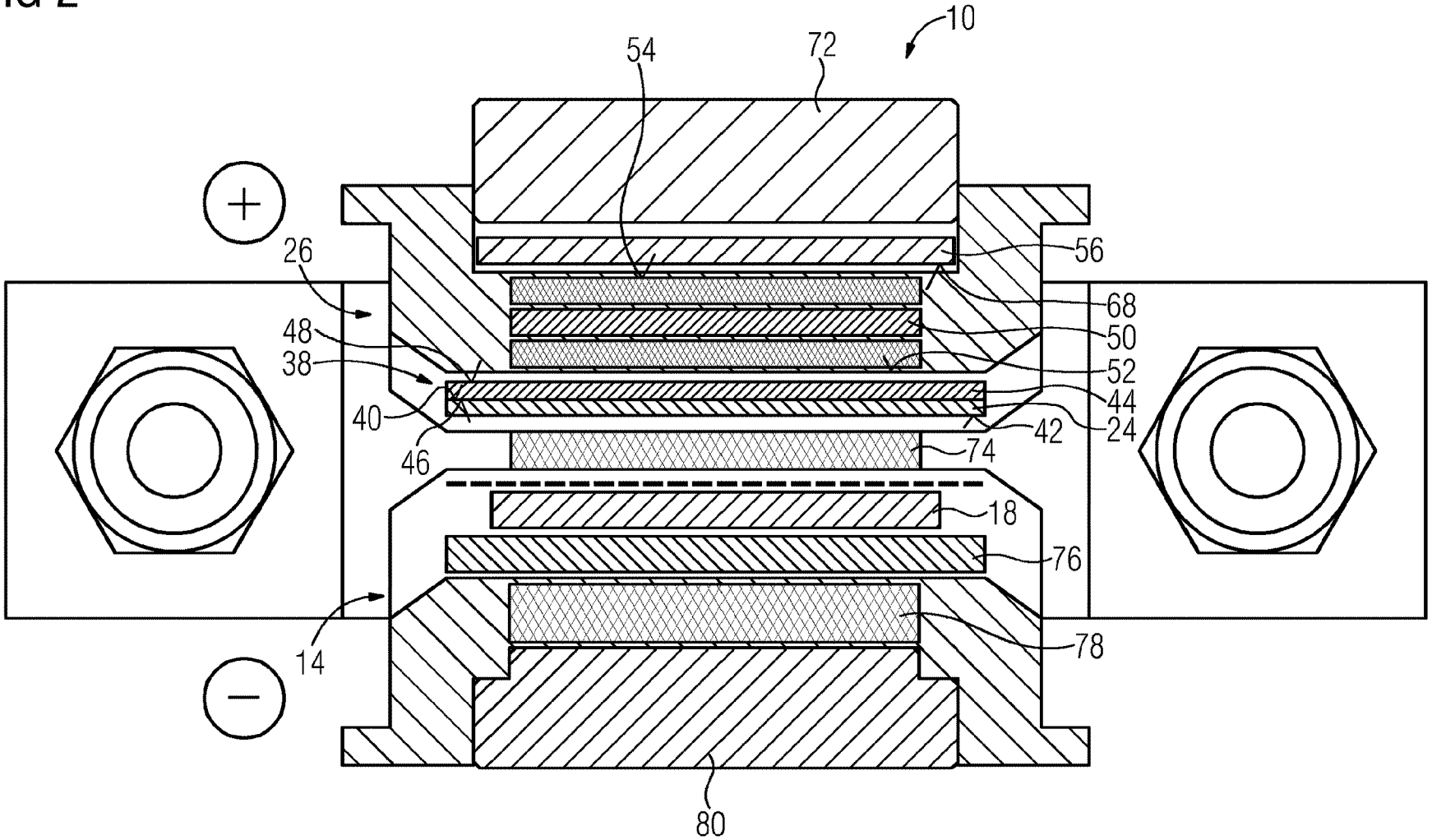
FIG. 2 shows a schematic section view of an electrochemical cell of the electrolysis device according to FIG. 1.

FIG. 2 shows, in a schematic section diagram, one of the electrochemical cells 10 according to FIG. 1. For the sake of clarity, the feed connections 20, 32 and the drain connections 22, 34 are not shown.

FIG. 2 shows a section view of one of the electrochemical cells 10. It is apparent that the electrochemical cell 10 has a stacked construction. The cathode region 14 comprises a catholyte element 74 adjoining a gas diffusion electrode 18 which, in the present context, at least partly constitutes the cathode. The gas diffusion electrode 18 also adjoins a contact frame 76 which, in the present context, is formed from silver or a silver alloy. The contact frame 76 adjoins a gas spacer element 78, one purpose of which is to supply carbon dioxide and to remove carbon monoxide. The gas spacer element 78 adjoins a window 80 that concludes the cathode region 14. In alternative configurations, rather than the window 80 or in addition thereto, it is also possible to provide an end plate or the like.

The catholyte element 74 also adjoins the separator 24, specifically a cathode-side separator surface 42. On the opposite side from the cathode-side separator surface, the separator 24 has an anode-side separator surface. The separator 24 in the present context is formed from a substance which is permeable to protons. In the present configuration, the material provided for the separator 24 is Nafion. In alternative configurations, it is of course possible here too to provide a different, correspondingly suitable material.

The construction and function of the gas diffusion electrode 18 is known, for example, from European patent application 19 182 017.4. Therefore, reference is made in this regard to the disclosure in this regard.

In the present configuration, the anode region 26 is formed as a construction unit together with the separator 24. In this way, it is possible to create a unit that can be handled separately, which simplifies the production of the electrochemical cell 10 and, with regard to reliability, is capable of providing improvement not just in production but also in operation as intended.

For this purpose, in the anode region 26, the separator 24 is formed with a catalyst layer 44 in the manner of a membrane-electrode assembly (MEA). For this purpose, the separator 24 likewise takes the form of a membrane. The separator 24 has the anode-side separator surface 40 and the cathode-side separator surface 42 on the opposite side from the anode-side separator surface 40. In addition, the catalyst layer 44 has a first catalyst surface 46 and a second catalyst surface 48 on the opposite side from the first catalyst surface 46. The first catalyst surface 46 faces the anode-side separator surface 40. In the present configuration, the first catalyst surface 46 is bonded in a fixed manner to the anode-side separator surface 40. The catalyst layer 44 may therefore be applied in the manner of a coating on the anode-side separator surface 40. This achieves a reliable fixed connection between the catalyst layer 44 and the separator 24.

The anode region 26 further comprises a fluid-permeable anode plate 50 having a first anode surface 52 and a second anode surface 54 on the opposite side from the first anode surface 52. The first anode surface 52 faces the second catalyst surface 48. In the present configuration, the first anode surface 52 is bonded to the second catalyst surface 48. As will be set out hereinafter, this connection can be implemented in different ways, specifically in accordance with the different working examples discussed hereinafter.

In the present context, the anode plate 50 is porous, in order to be able to achieve the desired gas permeability or else the desired permeability for a liquid, for example water or the like.

A contact plate 56 is disposed on the second anode surface 54. In this regard, the contact plate 56 has a contact plate surface 68 connected to the second anode surface 54. The contact plate 56 is electrically coupled to the electrical anode connection 28. At an opposite surface of the contact plate 56 from the contact plate surface 68 is disposed an end plate 72 that concludes the anode region 26 in the outward direction.

The separator 24, the catalyst layer 44 and the anode plate 50 form an anode-side half-cell 38 as a construction unit. According to the construction and requirements, the construction unit may also include the contact plate 56. The anode-side half-cell 38, especially the construction thereof, is elucidated in detail with reference to the further working examples that follow.

The catalyst layer 44 in the present context is formed predominantly from iridium(IV) oxide. However, it is also possible in principle—according to the desired functionality—to use a different metal oxide or else mixtures thereof.

The anode plate 50 and also the contact plate 56 in the present context are formed from a titanium alloy. This can achieve good electrical conductivity, such that the electrical anode potential over the anode surfaces 52, 54 is very substantially uniform or homogeneous. This promotes the efficacy of the electrolysis operation in the electrochemical cell 10.

The anolyte used may be water or else a salt solution, which simultaneously also provides the proton-releasing substance, such that protons can be provided for the desired electrochemical reaction of the carbon dioxide electrolysis.

At the anode, it is possible to achieve a chemical reaction according to the following equation:

$$2H_2O(l)+4OH^- \rightarrow O_2(g)+4e-+4H_2O(l)$$

At the cathode, a main reaction takes place according to the following chemical equation:

$$CO_2(g)+H_2O(l)+2e^- \rightarrow CO(g)+2OH^-$$

$$2H_2O(l)+2e^- \rightarrow H_2(g)+2OH^-$$

Figure 3:
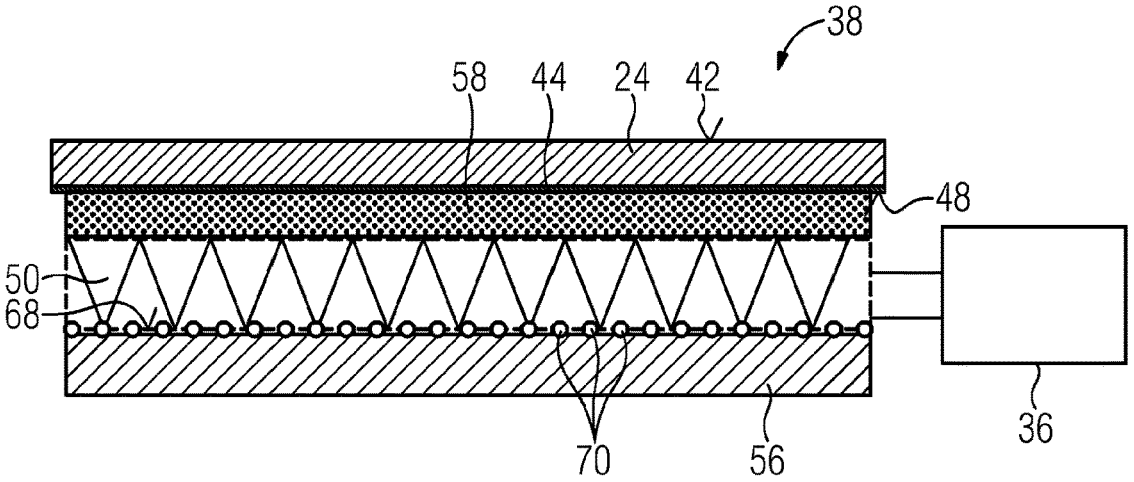
FIG. 3 shows a schematic section view of the anode-side half-cell of the electrochemical cell according to FIG. 2 in a first configuration.

FIG. 3 shows a first embodiment of the anode-side half-cell 38. It is apparent from FIG. 3 that the second catalyst surface 48 is bonded to the first anode surface 52 by means of an adhesive 58. The adhesive 58 in this configuration is a diffusion-open adhesive that establishes a cohesive bond between the second catalyst surface 48 and the first anode surface 52. The adhesive may, for example, include PTFE, PVDF and also N-methyl-2-pyrrolidone as solvent. N-Methyl-2-pyrrolidone dissolves the two aforementioned polymers after addition and then, after evaporation, forms a solid adhesive layer. However, it is also possible in principle to use other adhesion adhesives, for example based on epoxy resin or based on cyanoacrylate.

The adhesive 58 preferably consists of an identical or similar substance to the separator 24. It should generally be noted that, when Nafion, being a perfluorinated copolymer containing a sulfone group as ionic group, is used as material for the separator 24 as in the present context, a similar substance should as far as possible be used for the adhesive, which is capable of introducing no extraneous chemical components into the electrolysis process if at all possible, such that the electrolysis process can remain unimpaired if possible. Accordingly, the use of other adhesives is limited essentially in that the electrolysis process is not significantly impaired.

The second anode surface 54 is mechanically and electrically connected to the contact plate 56 via connecting elements 70. The connecting elements 70 may provide punctiform or continuous mechanical and electrical connection, for example by means of weld points or bonding points or by means of soldering or the like, according to suitability.

In the present configuration, the anode plate 50 is electrically coupled to the electrical energy source 36, specifically to the electrical anode potential thereof. By means of the contact plate 56, in the case of the porous anode plate 50, it is possible to achieve an essentially homogeneous adjustment of the electrical anode potential over the anode surfaces 52, 54 even in the case of high current density.

Figure 4:
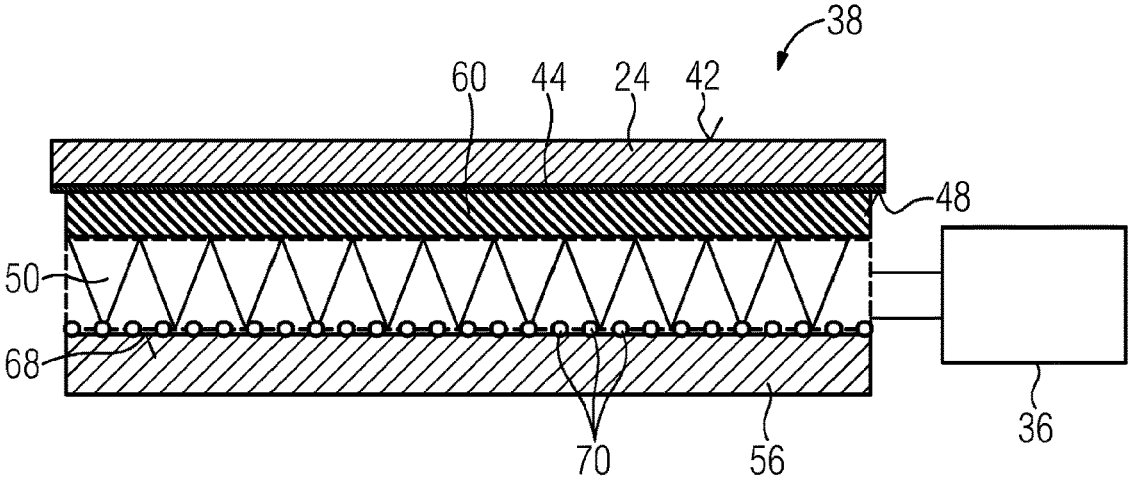
FIG. 4 shows a schematic section view like FIG. 3 in a second configuration.

FIG. 4 shows a further configuration of an anode-side half-cell 38 based on the configuration according to FIG. 3. By contrast with the configuration according to FIG. 3, in the configuration according to FIG. 4, the adhesive 58 is replaced by the adhesive 60. The further construction corresponds to the working example according to FIG. 3.

The adhesive 60 may in principle take the same form as the adhesive 58, but it also comprises fibers of iridium(IV) oxide. This can further improve function, especially with regard to catalytic action. Otherwise, the construction of the anode-side half-cell 38 corresponds to the construction as already elucidated with reference to FIG. 3. The adhesive 60 especially has higher electrical conductivity compared to the adhesive 58.

Figure 5:
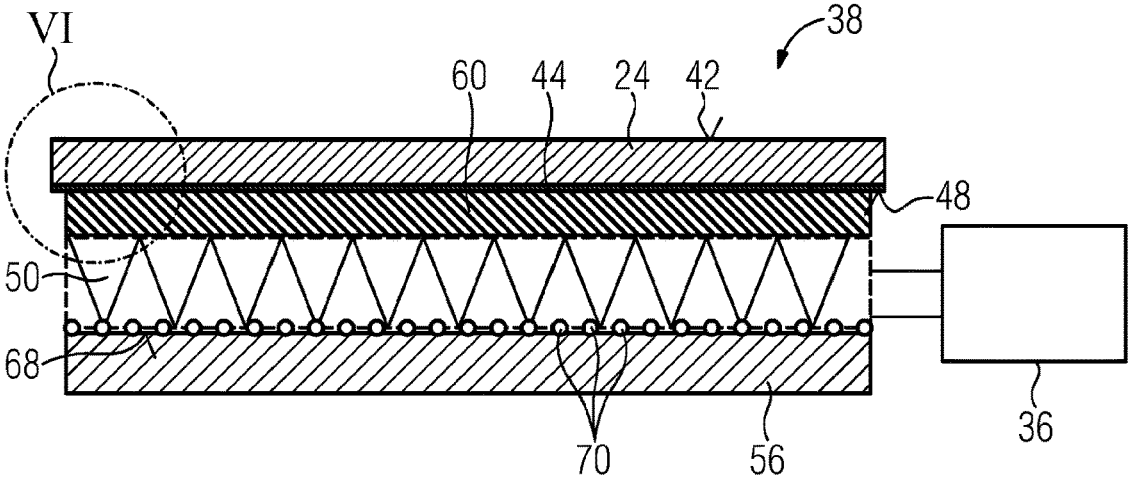
FIG. 5 shows a schematic section view like FIG. 3 in a third configuration.

FIG. 5 shows a further configuration for an anode-side half-cell 38 based on the configuration according to FIG. 4, and reference is therefore made additionally to the details in this regard.

In the configuration according to FIG. 5, iridium(IV) oxide fibers or iridium(IV) oxide-coated separator strips or optionally also other plastic or metal fibers or strips are applied on one side of the separator 24 as early as in the production of the separator 24, specifically on the anode-side separator surface 40. In a subsequent manufacturing step, the separator 24, which already contains the catalyst layer 44 as a result, is then bonded to the first anode surface 52 of the anode plate 50. The connection can be effected as elucidated with reference to FIGS. 3 and 4. In this way, it is possible to bond the catalyst layer 44 to the separator 24 in a more mechanically stable manner.

Figure 6:
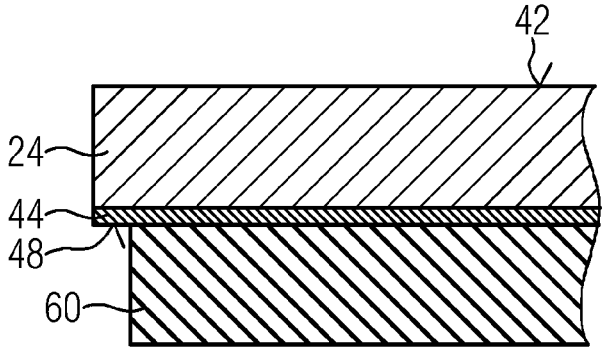
FIG. 6 shows a schematic enlarged representation of a region VI in FIG. 5.

The adhesive 58, 60 between the catalyst layer 44 and the anode plate 50 may, according to the application, be arranged over the whole area or else in a punctiform manner. FIG. 6 shows an enlarged detail of FIG. 5 in region VI.

Figure 7:
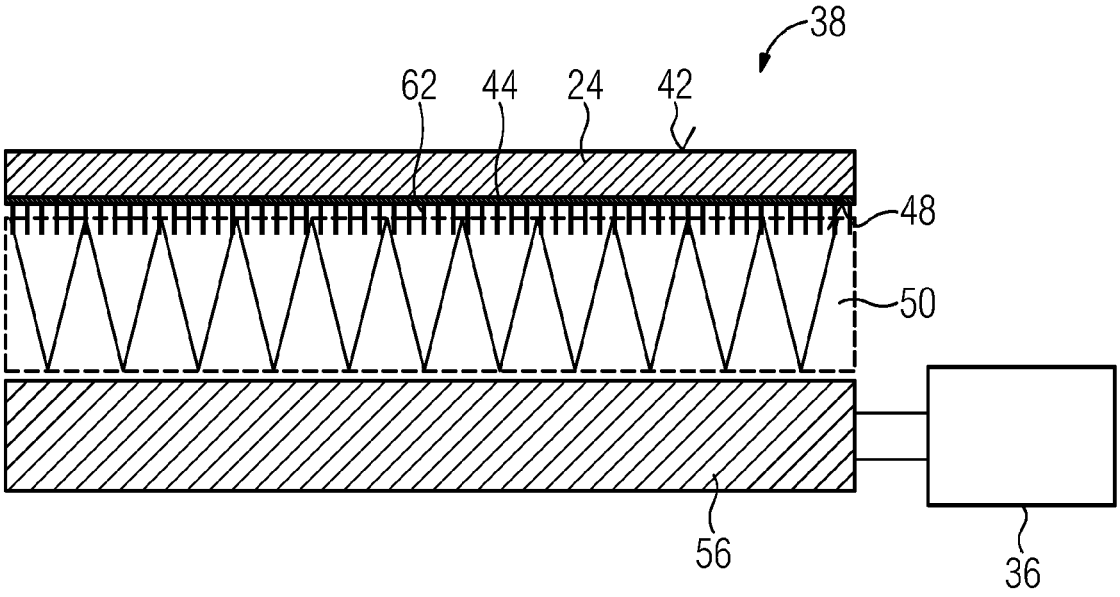
FIG. 7 shows a schematic section view based on FIG. 3 in a fourth configuration.

FIG. 7 shows a further configuration of an anode-side half-cell 38, which is based in principle on the above-described configurations according to FIGS. 3 to 6, and reference is therefore made additionally to the details in this regard. By contrast with the configurations according to FIGS. 3 to 6, no adhesive is provided in the configuration according to FIG. 7. Instead, the second catalyst surface 48 of the catalyst layer 44 has projections 62 of catalyst material that project through the first anode surface 52 into the anode plate 50. In this configuration, the electrical energy source 36 is additionally electrically coupled to the contact plate 56. In this way, it is possible to achieve both good electrical and mechanical connection, and simultaneously also good efficacy in relation to the envisaged electrolysis of carbon dioxide.

Figure 8:
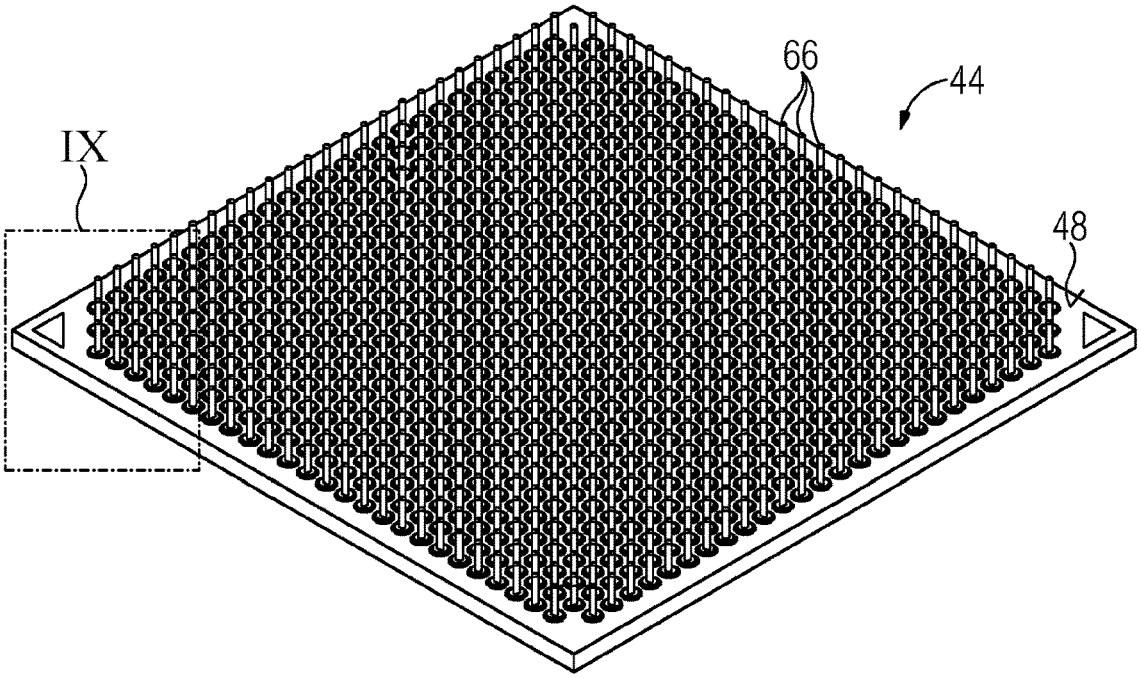
FIG. 8 shows a schematic perspective diagram of a catalyst surface with projections in the form of pins, in the configuration according to FIG. 7.
Figure 9:
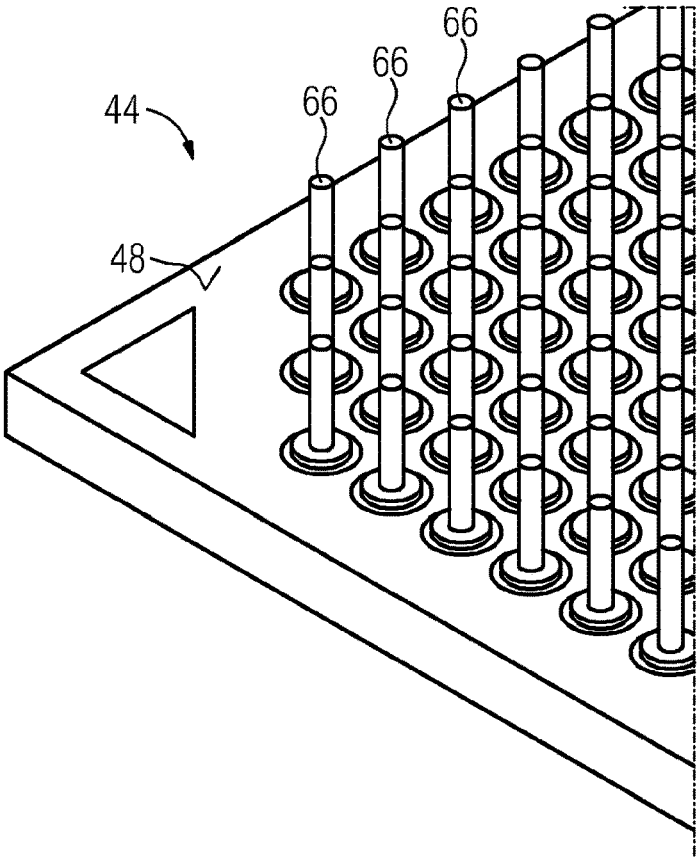
FIG. 9 shows an enlarged representation of a region IX in FIG. 8.
Figure 10:
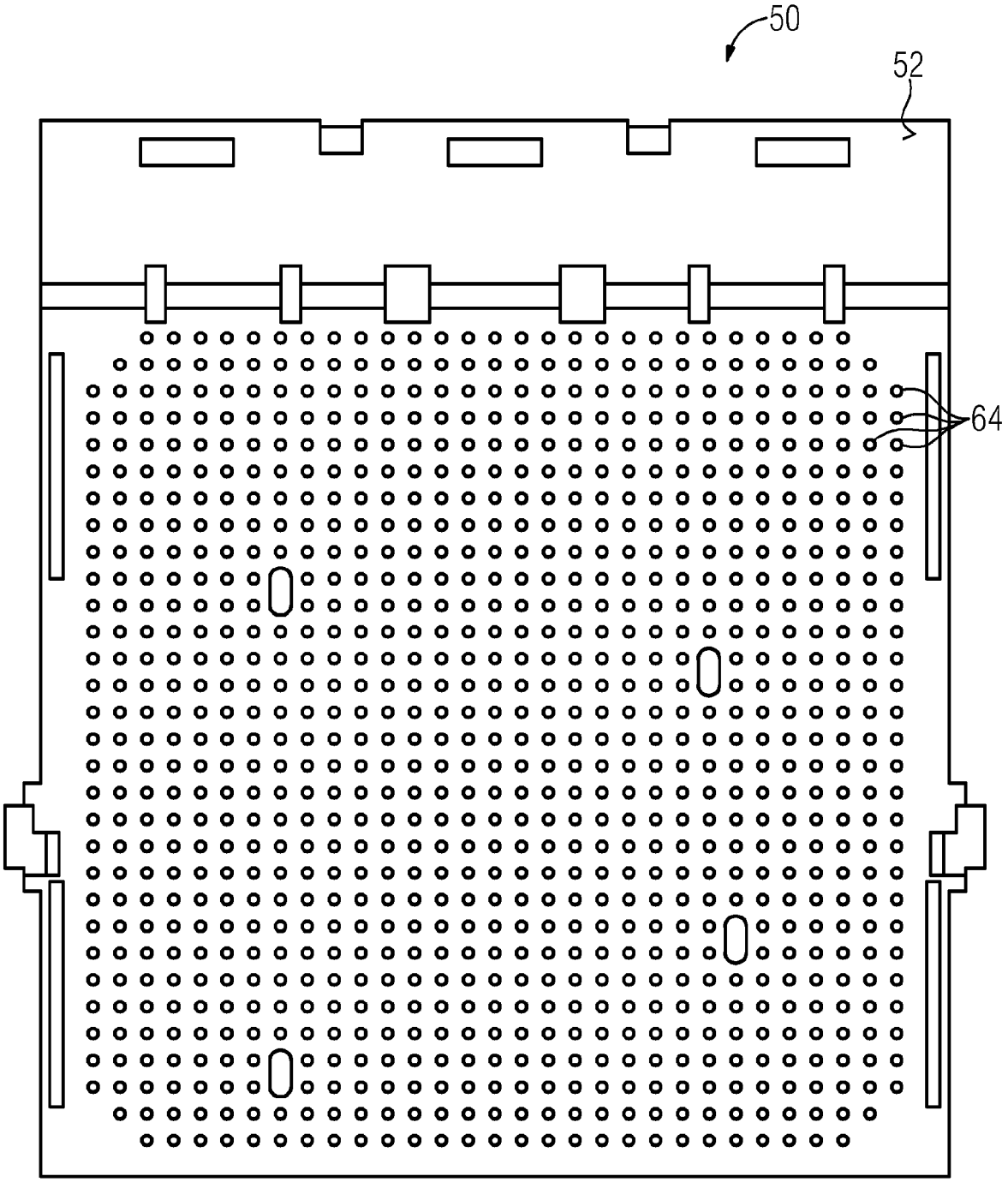
FIG. 10 shows a schematic top view of a first anode surface of an anode plate which serves for connection to the catalyst layer according to FIG. 8.

FIGS. 8 to 10 show a configuration based on the configuration according to FIG. 7. As apparent from FIGS. 8 to 10, the membrane arrangement composed of the separator 24 and the catalyst layer 44 may be connected to the anode plate 50 in a plug-connectable manner. This can achieve not just simple assembly but also releasability, which permits, if required, separability of the anode plate 50 from the membrane construction composed of the separator 24 and the catalyst layer 44. For this purpose, the configuration according to FIG. 7 envisages that the catalyst layer 44 provides the projections 62 as pins 66. These project from the second catalyst surface 48 (FIG. 8). FIG. 9 shows an enlarged detail in the region IX of FIG. 8.

FIG. 10 shows, in a schematic top view of the first anode surface 52, the anode plate 50. It is apparent that, according to the arrangement of the pins 66 in the catalyst layer 44 according to FIG. 8, receiving openings 64 are provided. In the case of bonding of the catalyst layer 44 to the anode plate 50, the pins 66 are introduced into the receiving openings 64. This can achieve a reliable mechanical and electrical connection between the anode plate 50 and the catalyst layer 44.

It may advantageously be the case that the connection is releasable. This can be achieved by means of an appropriate separation force, such that, ultimately, the anode plate 50 can be separated again in a simple manner from the catalyst layer 44. However, it is also possible in principle to provide an essentially force-free connection in that the anode plate 50 comprises a locking element that permits, in a first locking state, virtually force-free introduction of the pins 66 into the receiving openings 64 and, in a second locking state, fixing of the pins 66 in the receiving openings 64. In this way, it is simultaneously also possible to achieve simple releasable assembly.

Overall, the invention can achieve distinct simplification of the construction of the electrochemical cell 10 and of the electrolysis device 12. Furthermore, it is also possible to increase reliability. The catholyte used may, for example, be potassium hydrogencarbonate or else potassium sulfate or the like.

The anode-side half-cell 38 of the invention can achieve a Faraday efficiency within a range from about 90% to 100%, preferably about 95%. The electrolysis is preferably effected in a temperature range above room temperature. The temperature range may preferably be chosen from about 40° C. to about 90° C., more preferably at about 60° C.

The invention can achieve the following advantages:

- A fixed connection can be achieved between a contact structure on an anodic side by a composite composed of the catalyst layer and the separator.
- Frequent contact connection can achieve the effect that the anode potential, even in the case of a high current density, is essentially uniform over the area.
- The construction unit composed of the separator and the catalyst layer has much less of a tendency to swell and hence also less of a tendency to buckle from the contact connection.
- The coating of the separator with the catalyst can be protected from mechanical abrasion in the case of further handling in the realm of manufacturing or else in operation as intended.
- There is no need to expend any great force for the contact connection.
- It is possible to achieve improved handling in production and simplified assembly.

The aforementioned working examples serve exclusively to elucidate the invention and are not intended to restrict it.

The invention claimed is:

1. An anode-side half-cell for an electrochemical cell of an electrolysis device for carbon dioxide electrolysis and/or for carbon monoxide electrolysis, comprising:

a separator which is in the form of a membrane and has an anode-side separator surface and a cathode-side separator surface on the opposite side from the anode-side separator surface, a catalyst layer having a first catalyst surface and a second catalyst surface on the opposite side from the first catalyst surface, wherein the first catalyst surface faces the anode-side separator surface, a fluid-permeable anode plate having a first anode surface, wherein the first anode surface faces the second catalyst surface, wherein the second catalyst surface comprises cylindrically shaped projections that protrude from this surface and project into the anode plate through the first anode surface for bonding to the anode plate, wherein the first anode surface comprises cylindrically shaped receiving openings for receiving the cylindrically shaped projections; and wherein the cylindrically shaped projections and the cylindrically shaped receiving openings cooperate to define a releasable plug-connection between the catalyst layer and the anode plate.

2. The anode-side half-cell as claimed in claim 1, wherein the anode plate has a second anode surface on the opposite side from the first anode surface, wherein a contact plate is disposed on the second anode surface and wherein at least the anode plate or the contact plate serves for electrical connection to an electrical energy source which provides an electrical anode potential.

3. The anode-side half-cell as claimed in claim 2, wherein the contact plate has a contact plate surface which is on the opposite side from the second anode surface and has connecting elements at least for mechanical connection of the contact plate surface to the second anode surface.

4. The anode-side half-cell as claimed in claim 3, wherein the connecting elements and the contact plate are electrically conductive.

5. The anode-side half-cell as claimed in claim 1, wherein at least the anode plate or a contact plate includes titanium and/or a titanium alloy.

6. The anode-side half-cell as claimed in claim 1, wherein the anode plate is at least partly porous.

7. The anode-side half-cell as claimed in claim 1, wherein the cylindrically shaped projections are formed from the same material as the catalyst layer.

8. The anode-side half-cell as claimed in claim 1, wherein the cylindrically shaped projections are formed by mutually spaced pins.

9. The anode-side half-cell as claimed in claim 1, wherein an interface between the separator and the catalyst is free of an adhesive.

10. The anode-side half-cell as claimed in claim 1, wherein the releasable plug-connection comprises a force-free connection.

11. An electrochemical cell of an electrolysis device for carbon dioxide electrolysis and/or for carbon monoxide electrolysis, comprising:

a cathode region having an electrical cathode connection, a gas diffusion electrode, a first feed connection for supply of carbon dioxide and a first drain connection for draining of electrolysis substances at least partly formed in an intended operation of the electrochemical cell, an anode region which is formed separately from the cathode region by a separator and has an electrical anode connection, an anode plate, a second feed connection for supply of a proton-releasing substance and a second drain connection for draining of electrolysis residues at least partly formed in the intended operation of the electrochemical cell, wherein the cathode connection and the anode connection are designed to be electrically coupled to corresponding electrical connections of an electrical energy source that provides an electrical electrolysis voltage, wherein the anode region and the separator are designed as an anode-side half-cell as claimed in claim 1.

12. The electrochemical cell as claimed in claim 11, wherein elements of the cathode region and of the anode region are arranged in a stack.

13. An electrolysis device for carbon dioxide electrolysis and/or for carbon monoxide electrolysis, comprising:

electrochemical cells as claimed in claim 11, wherein the electrochemical cells are in a spatially directly adjoining arrangement.

14. A method of producing an anode-side half-cell for an electrochemical cell of an electrolysis device for carbon dioxide electrolysis and/or for carbon monoxide electrolysis, comprising:

arranging an anode-side separator surface of a separator which is in the form of a membrane and has a cathode-side separator surface on the opposite side from the anode-side separator surface at a first catalyst surface of a catalyst layer, which catalyst layer has a second catalyst surface on the opposite side from the first catalyst surface, arranging a first anode surface of a fluid-permeable anode plate at the second catalyst surface, wherein the second catalyst surface has cylindrically shaped projections that protrude from this surface and project into the anode plate through the first anode surface for bonding to the anode plate, wherein the first anode surface comprises cylindrically shaped receiving openings for receiving the cylindrically shaped projections; and wherein the cylindrically shaped projections and the cylindrically shaped receiving openings cooperate to define a releasable plug-connection between the catalyst layer and the anode plate.

* * * * *